US010367251B2

(12) United States Patent
Hwang et al.

(10) Patent No.: US 10,367,251 B2
(45) Date of Patent: Jul. 30, 2019

(54) SYSTEMS AND METHODS FOR INTEGRATED ANTENNA ARRANGEMENTS

(71) Applicant: Intel Corporation, Santa Clara, CA (US)

(72) Inventors: Huan-Sheng Hwang, San Diego, CA (US); Thomas Liu, Fremont, CA (US); Aycan Erentok, Sunnyvale, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/757,386

(22) Filed: Dec. 23, 2015

(65) Prior Publication Data

US 2017/0187096 A1 Jun. 29, 2017

(51) Int. Cl.

| | |
|---|---|
| ***H01Q 1/27*** | (2006.01) |
| ***H01Q 13/18*** | (2006.01) |
| ***H01Q 21/30*** | (2006.01) |

(52) U.S. Cl.

CPC ..... *H01Q 1/273* (2013.01); *H01Q 13/18* (2013.01); *H01Q 21/30* (2013.01)

(58) Field of Classification Search

CPC ..... H01Q 1/273; H01Q 13/10

See application file for complete search history.

(56) References Cited

U.S. PATENT DOCUMENTS

| | | | | |
|---|---|---|---|---|
| 5,532,705 | A * | 7/1996 | Hama | H01Q 1/273 343/702 |
| 8,836,587 | B2 | 9/2014 | Darnell et al. | |
| 2009/0289855 | A1* | 11/2009 | Zweers | H01Q 1/243 343/702 |
| 2010/0123632 | A1* | 5/2010 | Hill | H01Q 1/243 343/702 |
| 2013/0016016 | A1 | 1/2013 | Lin et al. | |
| 2015/0091764 | A1* | 4/2015 | Hsieh | H01Q 5/364 343/702 |
| 2015/0255855 | A1* | 9/2015 | Tsai | H01Q 1/273 343/702 |
| 2015/0263774 | A1 | 9/2015 | Sa et al. | |
| 2016/0006110 | A1* | 1/2016 | Jain | H01Q 5/328 343/702 |
| 2016/0344096 | A1* | 11/2016 | Erentok | H01Q 1/273 |
| 2017/0062912 | A1* | 3/2017 | Shewan | H01Q 1/273 |

FOREIGN PATENT DOCUMENTS

CN 104659493 A 5/2015

* cited by examiner

*Primary Examiner* — Daniel Munoz
(74) *Attorney, Agent, or Firm* — Schwegman Lundberg & Woessner, P.A.

(57) ABSTRACT

Various systems and methods for radiating RF transmissions outside of a portable electronic device with a conductive case. In an embodiment, this solution includes a conductive enclosure, a circuit board within the conductive enclosure, at least one non-conductive gap between the circuit board and the conductive enclosure, and a radio frequency (RF) connection between the circuit board and the conductive enclosure. The combination of enclosure and gaps can excite certain radiation modes at high frequency bands, such as a cavity-backed lambda-long slot radiation mode.

12 Claims, 5 Drawing Sheets

SYSTEMS AND METHODS FOR INTEGRATED ANTENNA ARRANGEMENTS

TECHNICAL FIELD

Embodiments described herein generally relate to electronic devices, and in particular, to electronic device antennas.

BACKGROUND

Industrial design is a key differentiator in connected wrist worn wearables market, and metal watchcases are often preferred by industrial designers that provide premium feeling and quality. However, many metal watch cases block or significantly attenuate the transmission of radio frequency (RF) transmissions. Watches may use RF transmissions to communicate with other devices using the industrial, scientific, and medical (ISM) radio bands. For example, a smartwatch may communicate with a nearby smartphone via Bluetooth, or may communicate with a wireless network via Wi-Fi. What is needed is an antenna for a wearable device that can radiate effectively within a conductive case.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings in which.

DETAILED DESCRIPTION

In the following description, for purposes of explanation, numerous specific details are set forth in order to provide a thorough understanding of some example embodiments. It will be evident, however, to one skilled in the art that the present disclosure may be practiced without these specific details.

Systems and methods described herein provide mechanisms to radiate RF transmissions outside of a portable electronic device with a conductive case. This antenna solution may be used within a watch, within an animal tag, or within another portable electronic RF device. As described below, this solution provides for a slot (e.g., gap) between a circuit board and a conductive enclosure (e.g., housing), where the slot is used to provide a radiation mode similar to a cavity-backed lambda-long slot radiation. This solution also provides for a simplified antenna topology, thus reducing manufacturing complexity. In particular, this simplified antenna topology provides an antenna radiating within the ISM band by only connecting a single antenna feed point from circuit board to the metal watch case, such as described below with respect to FIG. 1.

Figure 1:
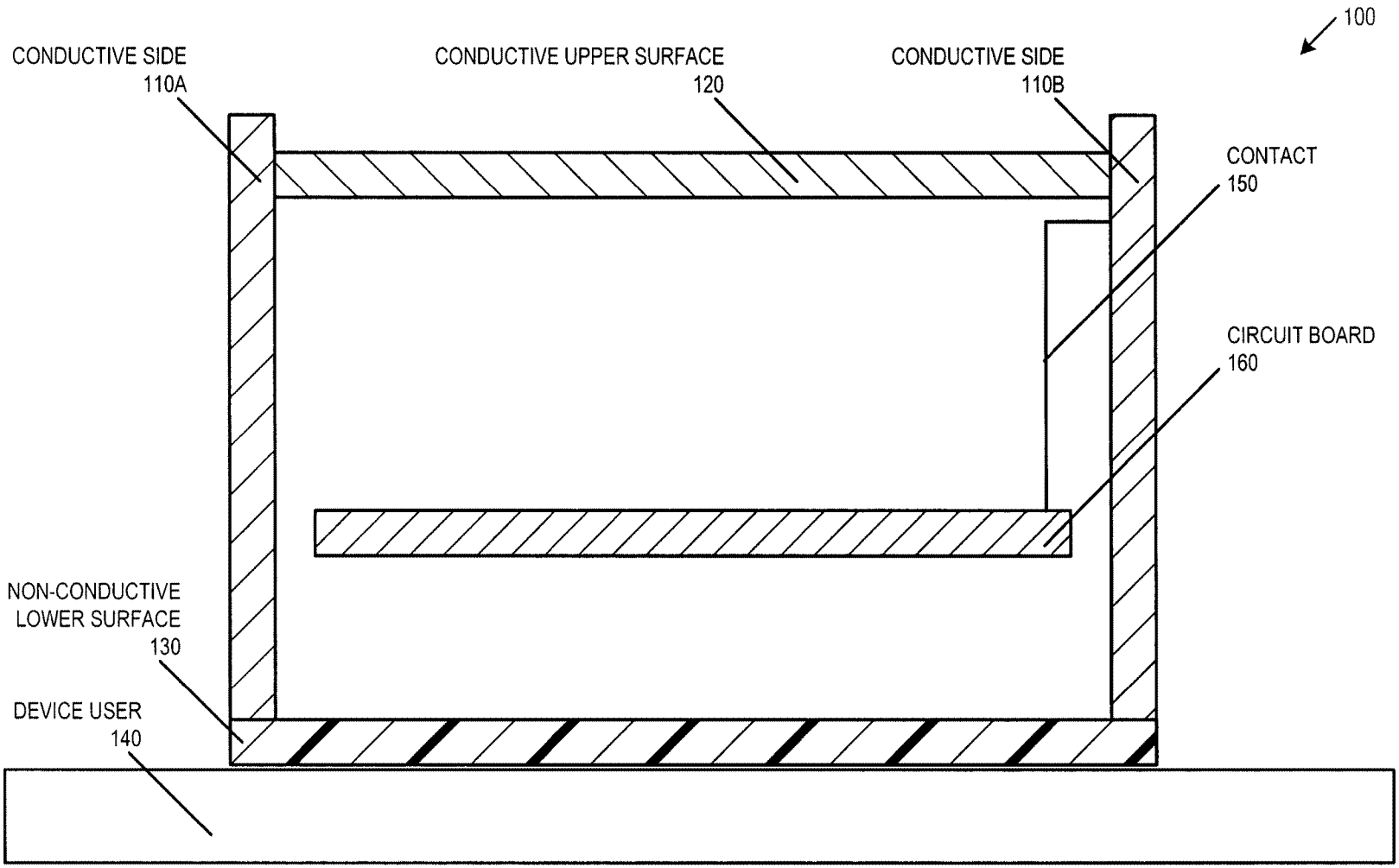
FIG. 1 is a block diagram illustrating a mobile electronic device antenna system, according to an embodiment.

FIG. 1 is a block diagram illustrating a mobile electronic device antenna topology 100, according to an embodiment. The antenna topology 100 is implemented within a mobile electronic device metal enclosure. Although embodiments are described herein with respect to mobile electronic devices, this antenna may be used in other electronic devices. The enclosure includes at least one conductive side surface 110A, a conductive upper surface 120, and a non-conductive lower surface 130. The enclosure may include a second conductive surface 110B such in a box-shaped enclosure. The second conductive surface 110B may connect to the first conductive side surface 110A, such as in a circular or elliptical-shaped enclosure. The conductive side surfaces 110A and 110B and the conductive upper surface 120 may be formed from a single conductive material, or may be formed from multiple conductive surfaces that are conductively coupled. As shown in FIG. 1, the shape and placement of non-conductive lower surface 130 insulates the conductive side surfaces 110A and 110B from a device user 140. In an example, the antenna system may be implemented in a wristwatch, and the non-conductive lower surface 130 may insulate the conductive side surfaces 110A and 110B from the user's wrist. Though FIG. 1 can be viewed as a wristwatch with a non-conductive lower surface 130, the conductive upper surface 120 may be implemented as the backing (e.g., a conductive lower surface), where the non-conductive lower surface 130 is implemented as the face (e.g., a non-conductive upper surface).

The conductive side surfaces 110A and 110B are electrically connected via a contact 150 to a device circuit board 160. The contact 150 may include an RF feed, such as a coaxial RF feed. The impedance of the RF feed is matched using conventional matching topologies, such as using inductors, capacitors, or resistors. This single contact 150 is in contrast with many existing solutions that require multiple ground contacts connecting an internal circuit board to an enclosure. Compared to the multiple-grounding solutions, this antenna topology 100 generates an excitation mode via the contact 150 without requiring any separate ground contact between the circuit board 160 and the conductive side surfaces 110A and 110B or conductive upper surface 120. Though no ground contact is used, a low-impendence shunt path (not shown) may be used to provide electrostatic discharge (ESD) protection. This mobile electronic device antenna topology 100 offers several advantages, including saving space on the mechanics volume, reducing the circuit board footprint, reducing total cost, and simplification of assembly line production. The configuration of the conductive side surfaces 110A and 110B, contact 150, and device circuit board 160 are used to form an antenna, as described below with respect to FIG. 2.

Figure 2:
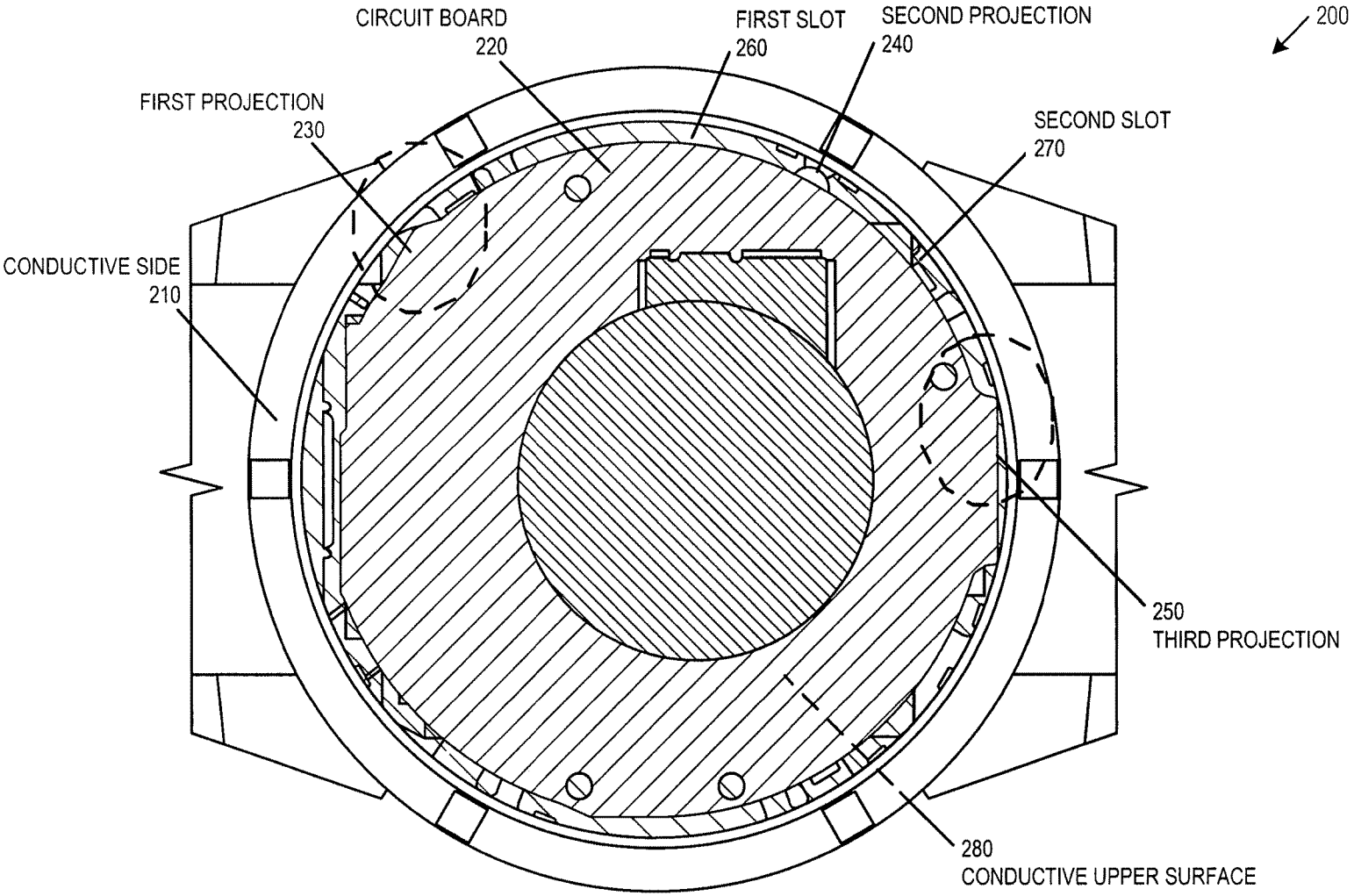
FIG. 2 is a diagram illustrating a wristwatch antenna system, according to an embodiment.

FIG. 2 is a diagram illustrating a wristwatch antenna topology 200, according to an embodiment. The wristwatch antenna topology 200 is an embodiment of the mobile electronic device antenna topology 100 shown in FIG. 1, such as a watch placed facedown with a removed backing. The wristwatch antenna topology 200 includes a conductive side 210, such as the watchcase. Topology 200 includes a circuit board 220 placed within the conductive side 210. The circuit board 220 includes multiple projections, such as a first projection 230, a second projection 240, and a third projection 250. The second projection 240 corresponds to the contact 150 shown in FIG. 1, and may be implemented using an RF antenna feed. In an embodiment, the second projection 240 is the only electrical contact with the conductive side 210. The first projection 230 and the second projection 240 form a first slot 260, and the second projection 240 and the third projection 250 form a second slot 270. The conductive side 210 and the conductive upper surface 280 combine with the first and second slot 260 and 270 to form a cavity-backed slot antenna, such as described below with respect to FIG. 3.

Figure 3:
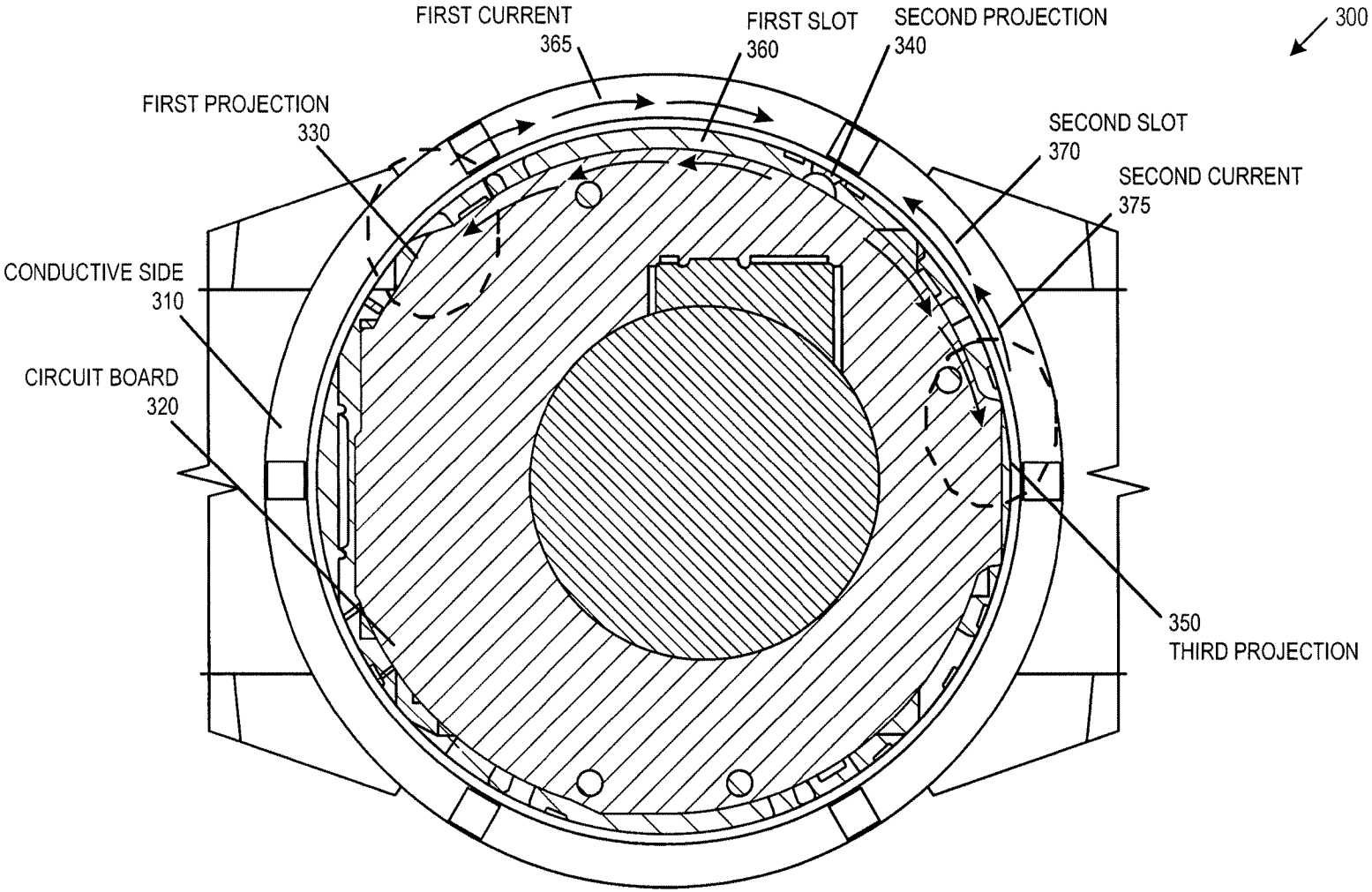
FIG. 3 is a diagram illustrating wristwatch large antenna surface currents, according to an embodiment.

FIG. 3 is a diagram illustrating wristwatch large antenna surface currents 300, according to an embodiment. A first projection 330 and a second projection 340 form a first slot 360, and a first current 365 flows around the first slot 360. Similarly, the second projection 340 and a third projection 350 form a second slot 370, and a second current 375 flows around the second slot 370. The first current 365 may flow in a first direction, and the second current 375 may flow in an opposite direction. While flowing in opposite directions, the first and second currents 365 and 375 do not interfere with each other, and instead add in a constructive manner through inductive coupling. The currents may be fed from a circuit board 320 through the second projection 340 between the first and second slots 360 and 370, where the second projection 340 may be an RF feedline. The large antenna surface currents 300 may be generated in response to an input signal, where the input signal is at a specific frequency or within a specific range of frequencies. In an example, the currents may be generated using a source RF signal between 2.40 GHz and 2.48 GHz, using a mid-channel 2.44 GHz source RF signal, may be generated using an RF signal to enable GLONASS, Bluetooth, Wi-Fi, or another protocol, or may be generated using another ISM band RF signal.

The first and second currents 365 and 375 flowing around the first and second slots 360 and 370 may result in a slot antenna excitation mode. The geometry of the first and second slots 360 and 370 may be selected such that each generates half-wavelength (e.g., $\lambda/2$) excitation mode for a selected ISM band. The combination of the radiation patterns of the first and second slots 360 and 370 may be combined to generate a lambda-long excitation mode that is similar to a cavity-backed slot antenna topology. Weaker currents may also flow on the circuit board 320 to the circuit board side opposite from the second projection 340, however the antenna radiation pattern is dominated by the current distribution in the close vicinity of the first and second slots 360 and 370. In various embodiments, this antenna topology has been shown to provide free-space antenna radiation efficiency of −8 dB, and to provide wrist-worn antenna radiation efficiency of −12.5 dB.

Alternative configurations are possible without departing from the present subject matter. The geometries of the circuit board 320 and conductive side 310 may be selected to improve the peak radiation efficiency, as peak radiation efficiency is dictated by the length of the current flow created on the circuit board 320 and conductive side 310. In some embodiments, the first and second slots 360 and 370 may be larger than would generate a 212 excitation mode. These alternative geometries would result in a radiation pattern similar to a distorted monopole antenna radiation pattern. In some embodiments, circuit board 320 may be rounded such that the first and third projections 330 and 350 are reduced or eliminated, such as in a circular circuit board 320. In this rounded circuit board 320 embodiment, a slot would be formed in the space between the rounded circuit board 320 and the conductive side 310. In some embodiments, a partially conductive lower surface (e.g., watch backing) may be used, such as including a smaller conducting surface within a larger non-conducting surface.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer). For example, a machine-readable storage device may include read-only memory (ROM), random-access memory (RAM), magnetic disk storage media, optical storage media, flash-memory devices, and other storage devices and media.

A processor subsystem may be used to execute the instruction on the machine-readable medium. The processor subsystem may include one or more processors, each with one or more cores. Additionally, the processor subsystem may be disposed on one or more physical devices. The processor subsystem may include one or more specialized processors, such as a graphics processing unit (GPU), a digital signal processor (DSP), a field programmable gate array (FPGA), or a fixed function processor.

Examples, as described herein, may include, or may operate on, logic or a number of components, modules, or mechanisms. Modules may be hardware, software, or firmware communicatively coupled to one or more processors in order to carry out the operations described herein. Modules may be hardware modules, and as such modules may be considered tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine-readable medium. In an example, the software, when executed by the underlying hardware of the module, causes the hardware to perform the specified operations. Accordingly, the term hardware module is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software; the general-purpose hardware processor may be configured as respective different modules at different times. Software may accordingly configure a hardware processor, for example, to constitute a particular module at one instance of time and to constitute a different module at a different instance of time. Modules may also be software or firmware modules, which operate to perform the methodologies described herein.

Figure 4:
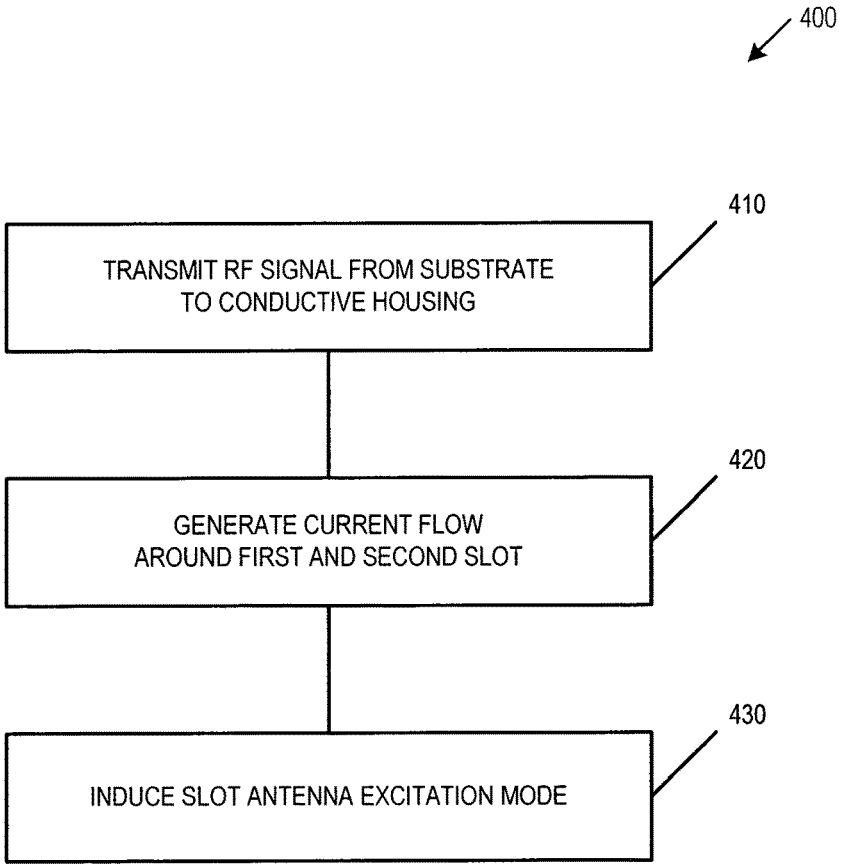
FIG. 4 is a flowchart of a method for generating a cavity-backed slot antenna excitation mode, according to an embodiment.

FIG. 4 is a flowchart of a method 400 for generating a cavity-backed slot antenna excitation mode, according to an embodiment. Method 400 includes transmitting 410 an RF signal from a circuit board (e.g., substrate) to a conductive enclosure. The circuit board may include a circuit board and an integrated circuit capable of generating an RF signal. The conductive enclosure includes a conductive side and a conductive upper surface. The RF signal may be transmitted 410 via an RF connection between the circuit board and the conductive enclosure side. In an embodiment, the RF connection is the only connection between the circuit board and the conductive enclosure, and no ground connections are used between the circuit board and the conductive enclosure.

Method 400 includes generating 420 a current flow around a first and second slot between the circuit board and the conductive enclosure, such as shown in FIG. 3. The geometry and relative arrangement of the circuit board and conductive housing may be selected to form a gap between the circuit board and conductive housing, and the RF connector may be used to separate the gap into the first and second slot. The current flow may be generated in response to transmitting 410 the RF signal from the circuit board via the RF connector to the conductive enclosure. The current flow around the first slot may be in a first direction, and the current flow around the second slot may be in an opposite direction from the current flow around the first slot. In an example, the currents may be generated using a source RF signal between 2.40 GHz and 2.48 GHz, using a mid-channel 2.44 GHz source RF signal, may be generated using an RF signal to enable GLONASS, Bluetooth, Wi-Fi, or another protocol, or may be generated using another ISM band RF signal.

Method 400 includes inducing 430 a slot antenna excitation mode. The slot antenna excitation mode may be induced 430 by the current flow around the first and second slots between the circuit board and the conductive housing. The conductive housing conductive side and a conductive upper surface may form a cavity, and the first and second currents may induce 430 a cavity-backed slot antenna excitation mode. The geometry and relative arrangement of the circuit board and conductive housing may be selected to form a first and second gap, where the first and second may be selected such that each generates half-wavelength (e.g., $\lambda/2$) excitation mode for a selected ISM band. The combination of the radiation patterns of the first and second gaps may be combined to generate a lambda-long excitation mode that is similar to a cavity-backed slot antenna topology. The geometry and relative arrangement may be selected to provide a peak radiation efficiency for a particular RF band, such as at a particular protocol.

Figure 5:
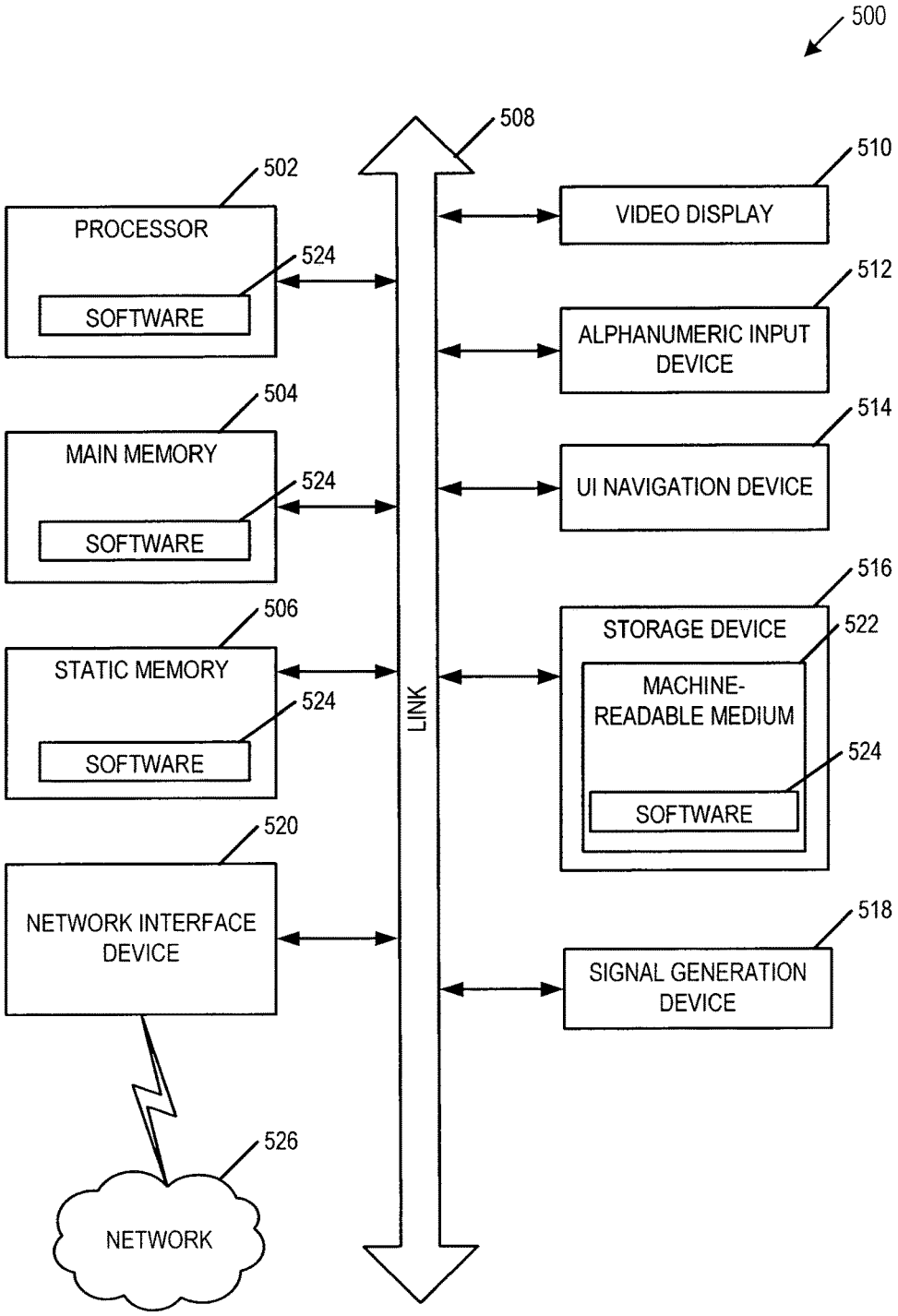
FIG. 5 is a block diagram illustrating a machine in the example form of a computer system, according to an example embodiment.

FIG. 5 is a block diagram illustrating a machine in the example form of a computer system 500, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, set-top box, portable electronic device, personal computer (PC), a tablet PC, a hybrid tablet, a personal digital assistant (PDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 500 includes at least one processor 502 (e.g., a central processing unit (CPU), a graphics processing unit (GPU) or both, processor cores, compute nodes, etc.), a main memory 504 and a static memory 506, which communicate with each other via a link 508 (e.g., bus). The computer system 500 may further include a video display unit 510, an alphanumeric input device 512 (e.g., a keyboard), and a user interface (UI) navigation device 514 (e.g., a mouse). In one embodiment, the video display unit 510, input device 512 and UI navigation device 514 are incorporated into a touch screen display. The computer system 500 may additionally include a storage device 516 (e.g., a drive unit), a signal generation device 518 (e.g., a speaker), a network interface device 520, and one or more sensors (not shown), such as a global positioning system (GPS) sensor, compass, accelerometer, or other sensor.

The storage device 516 includes a machine-readable medium 522 on which is stored one or more sets of data structures and instructions 524 (e.g., software) embodying or utilized by any one or more of the methodologies or functions described herein. The instructions 524 may also reside, completely or at least partially, within the main memory 504, static memory 506, and/or within the processor 502 during execution thereof by the computer system 500, with the main memory 504, static memory 506, and the processor 502 also constituting machine-readable media.

While the machine-readable medium 522 is illustrated in an example embodiment to be a single medium, the term "machine-readable medium" may include a single medium or multiple media (e.g., a centralized or distributed database, and/or associated caches and servers) that store the one or more instructions 524. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 524 may further be transmitted or received over a communications network 526 using a transmission medium via the network interface device 520 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, Bluetooth, Bluetooth LE, 3G, 4G LTE/LTE-A. WiMAX networks, etc.). The term "transmission medium" shall be taken to include any intangible medium that is capable of storing, encoding, or carrying instructions for execution by the machine, and includes digital or analog communications signals or other intangible medium to facilitate communication of such software.

ADDITIONAL NOTES & EXAMPLES

Example 1 is an apparatus for an electronic device antenna, the apparatus comprising: a conductive enclosure, the conductive enclosure including a conductive side and a conductive first surface; a circuit board within the conductive enclosure, the circuit board forming a first slot between a circuit board edge and the conductive side of the conductive enclosure; and a radio frequency (RF) connection between the circuit board and the conductive enclosure.

In Example 2, the subject matter of Example 1 optionally includes the circuit board transmitting an RF signal via the RF connection to the conductive enclosure.

In Example 3, the subject matter of Example 2 optionally includes wherein the circuit board transmitting the RF signal induces a first current flow around the first slot.

In Example 4, the subject matter of any one or more of Examples 2-3 optionally include wherein the circuit board transmitting the RF signal via the RF connection is without requiring a separate galvanic connection between the circuit board and the conductive enclosure.

In Example 5, the subject matter of Example 4 optionally includes wherein the first current flow around the first slot induces a first slot antenna excitation mode.

In Example 6, the subject matter of Example 5 optionally includes wherein the geometry of the first slot is selected to cause the first slot antenna excitation mode to radiate as a slot antenna within a selected RF frequency band.

In Example 7, the subject matter of any one or more of Examples 5-6 optionally include wherein the geometry of the first slot is selected to cause the first slot antenna excitation mode to radiate along a half-wavelength slot.

In Example 8, the subject matter of any one or more of Examples 5-7 optionally include wherein the circuit board forms a second slot between the circuit board edge and the conductive side.

In Example 9, the subject matter of Example 8 optionally includes wherein the circuit board transmitting the RF signal further induces a second current flow around the second slot.

In Example 10, the subject matter of any one or more of Examples 8-9 optionally include wherein the second current flow is in a direction opposite from the first current flow induced by the RF signal transmitted by the circuit board.

In Example 11, the subject matter of any one or more of Examples 8-10 optionally include wherein the RF connection is disposed between the first slot and the second slot.

In Example 12, the subject matter of any one or more of Examples 8-11 optionally include wherein the second current flow around the second slot induces a second slot antenna excitation mode.

In Example 13, the subject matter of Example 12 optionally includes wherein the geometry of the second slot is selected to cause the second slot antenna excitation mode to radiate as a slot antenna within the selected RF frequency band along a half-wavelength slot.

In Example 14, the subject matter of any one or more of Examples 12-13 optionally include wherein the first slot antenna excitation mode and the second slot antenna excitation mode combine to radiate in a lambda-long excitation mode.

In Example 15, the subject matter of any one or more of Examples 12-14 optionally include wherein the first slot antenna excitation mode and the second slot antenna excitation mode combine within the conductive enclosure to radiate in a cavity-backed lambda-long slot antenna excitation mode.

Example 16 is a method comprising: generating a first current flow around a first slot, the first slot formed between a circuit board and a conductive housing, the conductive enclosure including a conductive side and a conductive first surface; wherein the first current flow is generated based on transmitting an RF signal from the circuit board to the conductive housing.

In Example 17, the subject matter of Example 16 optionally includes wherein the RF signal is transmitted via an RF connection between the circuit board and the conductive housing.

In Example 18, the subject matter of Example 17 optionally includes wherein the circuit board transmitting the RF signal via the RF connection is without requiring a separate galvanic connection between the circuit board and the conductive enclosure.

In Example 19, the subject matter of Example 18 optionally includes wherein the first current flow around the first slot induces a first slot antenna excitation mode.

In Example 20, the subject matter of Example 19 optionally includes wherein the geometry of the first slot is selected to cause the first slot antenna excitation mode to radiate as a slot antenna within a selected RF frequency band.

In Example 21, the subject matter of any one or more of Examples 19-20 optionally include wherein the geometry of the first slot is selected to cause the first slot antenna excitation mode to radiate along a half-wavelength slot.

In Example 22, the subject matter of any one or more of Examples 16-21 optionally include generating a second current flow around a second slot, the second slot formed between the circuit board edge and the conductive side.

In Example 23, the subject matter of Example 22 optionally includes wherein the second current flow is generated based on transmitting the RF signal.

In Example 24, the subject matter of any one or more of Examples 22-23 optionally include wherein the second current flow is in a direction opposite from the first current flow induced by the RF signal transmitted by the circuit board.

In Example 25, the subject matter of any one or more of Examples 22-24 optionally include wherein the RF connection is disposed between the first slot and the second slot.

In Example 26, the subject matter of any one or more of Examples 22-25 optionally include wherein the second current flow around the second slot induces a second slot antenna excitation mode.

In Example 27, the subject matter of Example 26 optionally includes wherein the geometry of the second slot is selected to cause the second slot antenna excitation mode to radiate as a slot antenna within the selected RF frequency band along a half-wavelength slot.

In Example 28, the subject matter of any one or more of Examples 26-27 optionally include wherein the first slot antenna excitation mode and the second slot antenna excitation mode combine to radiate in a lambda-long excitation mode.

In Example 29, the subject matter of any one or more of Examples 26-28 optionally include wherein the first slot antenna excitation mode and the second slot antenna excitation mode combine within the conductive enclosure to radiate in a cavity-backed lambda-long slot antenna excitation mode.

Example 30 is a machine-readable medium including instructions, which when executed by a computing system, cause the computing system to perform any of the methods of Examples 16 to 25.

Example 31 is an apparatus comprising means for performing any of the methods of Examples 16 to 25.

Example 32 is at least one machine-readable storage medium, comprising a plurality of instructions that, responsive to being executed with processor circuitry of a computer-controlled device, cause the computer-controlled device to: generate a first current flow around a first slot, the first slot formed between a circuit board and a conductive housing, the conductive enclosure including a conductive side and a conductive first surface; wherein the first current flow is generated based on the instructions causing the computer-controlled device to transmit an RF signal from the circuit board to the conductive housing.

In Example 33, the subject matter of Example 32 optionally includes wherein the instructions cause the computer-controlled device to transmit the RF signal via an RF connection between the circuit board and the conductive housing.

In Example 34, the subject matter of Example 33 optionally includes wherein the instructions cause the computer-controlled device to transmit the RF signal without requiring a separate galvanic connection between the circuit board and the conductive enclosure.

In Example 35, the subject matter of Example 34 optionally includes wherein the first current flow around the first slot induces a first slot antenna excitation mode.

In Example 36, the subject matter of Example 35 optionally includes wherein a geometry of the first slot is selected to cause the first slot antenna excitation mode to radiate as a slot antenna within a selected RF frequency band.

In Example 37, the subject matter of Example 36 optionally includes wherein the geometry of the first slot is selected to cause the first slot antenna excitation mode to radiate along a half-wavelength slot.

In Example 38, the subject matter of any one or more of Examples 32-37 optionally include wherein the instructions further cause the computer-controlled device to generate a second current flow around a second slot, the second slot formed between the circuit board edge and the conductive side.

In Example 39, the subject matter of Example 38 optionally includes wherein the second current flow is generated based on transmitting the RF signal.

In Example 40, the subject matter of any one or more of Examples 38-39 optionally include wherein the second current flow is in a direction opposite from the first current flow induced by the RF signal transmitted by the circuit board.

In Example 41, the subject matter of any one or more of Examples 38-40 optionally include wherein the RF connection is disposed between the first slot and the second slot.

In Example 42, the subject matter of any one or more of Examples 38-41 optionally include wherein the second current flow around the second slot induces a second slot antenna excitation mode.

In Example 43, the subject matter of Example 42 optionally includes wherein the geometry of the second slot is selected to cause the second slot antenna excitation mode to radiate as a slot antenna within the selected RF frequency band along a half-wavelength slot.

In Example 44, the subject matter of any one or more of Examples 42-43 optionally include wherein the first slot antenna excitation mode and the second slot antenna excitation mode combine to radiate in a lambda-long excitation mode.

In Example 45, the subject matter of any one or more of Examples 42-44 optionally include wherein the first slot antenna excitation mode and the second slot antenna excitation mode combine within the conductive enclosure to radiate in a cavity-backed lambda-long slot antenna excitation mode.

Example 46 is an apparatus comprising: means for generating a first current flow around a first slot, the first slot formed between a circuit board and a conductive housing, the conductive enclosure including a conductive side and a conductive first surface; wherein the means for generating the first current flow includes means for transmitting an RF signal from the circuit board to the conductive housing.

In Example 47, the subject matter of Example 46 optionally includes wherein the means for transmitting the RF signal includes an RF connection between the circuit board and the conductive housing.

In Example 48, the subject matter of Example 47 optionally includes wherein the means for transmitting the RF signal is without requiring a separate galvanic connection between the circuit board and the conductive enclosure.

In Example 49, the subject matter of Example 48 optionally includes wherein the first current flow around the first slot induces a first slot antenna excitation mode.

In Example 50, the subject matter of any one or more of Examples 46-49 optionally include wherein the geometry of the first slot is selected to cause the first slot antenna excitation mode to radiate as a slot antenna within a selected RF frequency band.

In Example 51, the subject matter of Example 50 optionally includes wherein the geometry of the first slot is selected to cause the first slot antenna excitation mode to radiate along a half-wavelength slot.

In Example 52, the subject matter of any one or more of Examples 46-51 optionally include means for generating a second current flow around a second slot, the second slot formed between the circuit board edge and the conductive side.

In Example 53, the subject matter of Example 52 optionally includes wherein the means for generating the second current flow is based on transmitting the RF signal.

In Example 54, the subject matter of any one or more of Examples 52-53 optionally include wherein the second current flow is in a direction opposite from the first current flow induced by the RF signal transmitted by the circuit board.

In Example 55, the subject matter of any one or more of Examples 52-54 optionally include wherein the RF connection is disposed between the first slot and the second slot.

In Example 56, the subject matter of any one or more of Examples 52-55 optionally include wherein the second current flow around the second slot induces a second slot antenna excitation mode.

In Example 57, the subject matter of Example 56 optionally includes wherein the geometry of the second slot is selected to cause the second slot antenna excitation mode to radiate as a slot antenna within the selected RF frequency band along a half-wavelength slot.

In Example 58, the subject matter of any one or more of Examples 56-57 optionally include wherein the first slot antenna excitation mode and the second slot antenna excitation mode combine to radiate in a lambda-long excitation mode.

In Example 59, the subject matter of any one or more of Examples 56-58 optionally include wherein the first slot antenna excitation mode and the second slot antenna excitation mode combine within the conductive enclosure to radiate in a cavity-backed lambda-long slot antenna excitation mode.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplated are examples using any combination or permutation of those elements shown or described (or one or more aspects thereof), either with respect to a particular example (or one or more aspects thereof), or with respect to other examples (or one or more aspects thereof) shown or described herein.

Publications, patents, and patent documents referred to in this document are incorporated by reference herein in their entirety, as though individually incorporated by reference. In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. An apparatus for an electronic device antenna, the apparatus comprising:

a conductive enclosure, the conductive enclosure including a conductive inner surface;

a circuit board within the conductive inner surface of the conductive enclosure, the circuit board including a first protrusion and a second protrusion, each protrusion conductively coupling the circuit board with the conductive inner surface; and a radio frequency (RF) connection between the first protrusion and the second protrusion, the RF connection providing a current return to the circuit board from the conductive inner surface, the RF connection and circuit board forming a first radiating slot antenna conductive flow loop along a circuit board edge to the first protrusion and along the conductive inner surface to the RF connection, and forming a second radiating slot antenna conductive flow loop along the circuit board edge to the second protrusion and along the conductive inner surface to the RF connection, the first and second conductive flow loops providing a slot antenna excitation mode that radiates substantially perpendicular to the circuit board.

2. The apparatus of claim 1, the circuit board transmitting an RF signal via the RF connection to the conductive enclosure.

3. The apparatus of claim 2, wherein the circuit board transmitting the RF signal induces a first current flow around the first slot antenna conductive flow loop.

4. The apparatus of claim 2, wherein the circuit board transmitting the RF signal via the RE connection is without requiring a separate galvanic connection between the circuit board and the conductive enclosure.

5. The apparatus of claim 4, wherein the first current flow around the first slot antenna conductive flow loop induces a first slot antenna excitation mode.

6. The apparatus of claim 5, wherein: the circuit board transmitting the RF signal further induces a second current flow around the second slot antenna conductive flow loop; the second current flow around the second slot antenna conductive flow loop induces a second slot antenna excitation mode; the geometry of the first slot antenna conductive flow loop and second slot antenna conductive flow loop are selected such that the first slot antenna excitation mode and the second slot antenna excitation mode each radiate in a half-wavelength excitation mode; the conductive enclosure further includes a conductive upper surface to form a cavity; and the first slot antenna excitation mode and the second slot antenna excitation mode combine constructively within the conductive enclosure to radiate perpendicular to the circuit board in a cavity-backed full-wavelength slot antenna excitation mode.

7. A method comprising:

generating a first current flow around a first slot antenna conductive flow loop, the first slot antenna conductive flow loop formed from an RF connection along a circuit board edge to a first protrusion and along a conductive inner surface of a conductive enclosure, the circuit board disposed within the conductive inner surface; and generating a second current flow around a second slot antenna conductive flow loop, the second slot antenna conductive flow loop formed between the RF connection along the circuit board edge to a second protrusion and along the conductive inner surface, the RF connection between the first protrusion and the second protrusion;

wherein the first current flow and second current flow are generated based on transmitting an RF signal from the RF connection through the circuit board to the conductive inner surface; the RF connection providing a current return to the circuit board, the first current flow causing the first slot antenna conductive flow loop to radiate as a first radiating slot antenna substantially perpendicular to the circuit board, the second current flow causing the second slot antenna conductive flow loop to radiate as a second radiating slot antenna substantially perpendicular to the circuit board and constructively with the first radiating slot antenna.

8. The method of claim 7, wherein the circuit board transmitting the RF signal via the RF connection is without requiring a separate galvanic connection between the circuit board and the conductive inner surface.

9. The method of claim 7, wherein: the first current flow around the first slot antenna conductive flow loop induces a first slot antenna excitation mode; the second current flow around the second slot antenna conductive flow loop induces a second slot antenna excitation mode; the geometry of the first slot antenna conductive flow loop and second slot antenna conductive flow loop are selected such that the first slot antenna excitation mode and the second slot antenna excitation mode each radiate in a half-wavelength excitation mode; the conductive enclosure further includes a conductive upper surface to form a cavity; and the first slot antenna excitation mode and the second slot antenna excitation mode combine constructively within the conductive inner surface to radiate perpendicular to the circuit board in a cavity-backed full-wavelength slot antenna excitation mode.

10. At least one non-transitory machine-readable storage medium, comprising a plurality of instructions that, responsive to being executed with processor circuitry of a computer-controlled device, cause the computer-controlled device to:

generate a first current flow around a first slot antenna conductive flow loop, the first slot antenna conductive flow loop formed from an RF connection along a circuit board edge to a first protrusion and along a conductive inner surface of a conductive enclosure, the circuit board disposed within the conductive inner surface; and generate a second current flow around a second slot antenna conductive flow loop, the second slot antenna conductive flow loop formed between the RF connection along the circuit board edge to a second protrusion and along the conductive inner surface, the RF connection between the first protrusion and the second protrusion;

wherein the first current flow and second current flow are generated based on the instructions causing the computer-controlled device to transmit an RF signal from the RF connection through the circuit board to the conductive inner surface, the RF connection providing a current return to the circuit board, the first current flow causing the first slot antenna conductive flow loop to radiate as a first radiating slot antenna substantially perpendicular to the circuit board the second current flow causing the second slot antenna conductive flow loop to radiate as a second radiating slot antenna substantially perpendicular to the circuit board and constructively with the first radiating slot antenna.

11. The machine-readable storage medium of claim 10, wherein the instructions cause the computer-controlled device to transmit the RF signal without requiring a separate galvanic connection between the circuit board and the conductive inner surface.

12. The machine-readable storage medium of claim 11, wherein:

the first current flow around the first slot antenna conductive flow loop induces a first slot antenna excitation mode;

the second current flow around the second slot antenna conductive flow loop induces a second slot antenna excitation mode;

the geometry of the first slot antenna conductive flow loop and second slot antenna conductive flow loop are selected such that the first slot antenna excitation mode and the second slot antenna excitation mode each radiate in a half-wavelength excitation mode;

the conductive enclosure further includes a conductive upper surface to form a cavity; and the first slot antenna excitation mode and the second slot antenna excitation mode combine constructively within the conductive inner surface to radiate perpendicular to the circuit board in a cavity-backed full-wavelength slot antenna excitation mode.

* * * * *